United States Patent [19]

Kleine et al.

[11] 4,208,838

[45] Jun. 24, 1980

[54] LATCH HARDWARE

[75] Inventors: Ewald Kleine, Siegen; Ernst Roth, Wilnsdorf, both of Fed. Rep. of Germany

[73] Assignee: Siegenia-Frank KG, Siegen, Fed. Rep. of Germany

[21] Appl. No.: 877,118

[22] Filed: Feb. 13, 1978

[30] Foreign Application Priority Data

Feb. 12, 1977 [DE] Fed. Rep. of Germany ..... 2706013

[51] Int. Cl.[2] ..... E05D 15/52

[52] U.S. Cl. ..... 49/192

[58] Field of Search ..... 49/192, 193

[56] References Cited

U.S. PATENT DOCUMENTS

| | | | |
|---|---|---|---|
| 3,368,306 | 2/1968 | Wedel et al. | 49/192 |
| 3,434,238 | 3/1969 | Muller | 49/192 |
| 3,994,093 | 11/1976 | Mayer et al. | 49/192 |

FOREIGN PATENT DOCUMENTS

| | | | |
|---|---|---|---|
| 1269535 | 5/1968 | Fed. Rep. of Germany | 49/192 |
| 1271592 | 6/1968 | Fed. Rep. of Germany | 49/192 |
| 1801914 | 10/1968 | Fed. Rep. of Germany . | |
| 2159244 | 7/1973 | Fed. Rep. of Germany | 49/192 |
| 2509440 | 9/1976 | Fed. Rep. of Germany | 49/192 |

*Primary Examiner*—Philip C. Kannan

*Attorney, Agent, or Firm*—Norman S. Blodgett; Gerry A. Blodgett

[57] ABSTRACT

Latch hardware including drive rod fittings in which at least two profile grooves are undercut at an angle to one another within the frame shanks and drive rods are positioned, guided, and coupled to a corner guide. The profile grooves within the frame shanks are arranged stepwise and are of a depth which is larger than the thickness of the drive rods. In addition, the angled housing for the corner guide has at least one shank which is pushed on safety sleeves on molded edge stems in which may also be fixedly positioned parts which serve to guide the driving rod.

7 Claims, 16 Drawing Figures

LATCH HARDWARE

BACKGROUND OF THE INVENTION

German Pat. No. 1,269,535 has already shown that in drive rod fittings of this type, the angle housing of a corner guide can be fixedly mounted with safety sleeves which, for guiding the driving rod in connection with undercut profile grooves of frame shanks of windows, doors, etc. Also, it has been suggested by German Pat. No. 1,271,592 that one shank of the angled housing for the corner guide be held by machined edge stems within undercut profiles of the frame shanks of the windows and to fix the other shank with covering hardware or safety bars between the hardware fitting and the undercut part of the profile grooves.

In all these known cases, the profile grooves within the wings or frame shanks have a cross-section close to the cross-section of the driving rods guided within them, so that both shanks of the angle housing of the corner guide (and in some cases also the safety sleeves serving to hold them in place) extend relatively far out of the opening slot of the profile grooves. Because of this, difficulties result due to the fact that at the side of the shanks of the angled housing for the corner guide additional hardware parts have to pass, these being necessary for an orderly operation of the window or door and space must necessarily be available between the wing and frame groove areas for mounting. These necessary functional hardware elements can consist of tilt-out devices of a known design, for instance, which serve on turn-tilt windows not only to limit the tilt opening width of the wing, but are often used also for forming the upper turn linkage of the wing and for this purpose is coupled with the wing by an adjustable lock member. These functional hardware members can be locking members and can also be of the type that are used on the known Baskuel-rods arranged at the closure side of the wing extending over the wing corners and pushed into closure parts fastened to the frame. Such Baskuel-rod type operating lock levers are often used on turn-tilt wings for windows and doors for forming so-called tilt lock fittings. Such a tilt lock fitting has the purpose (on one hand) of locking wing in its closed position in the vicinity of its lower corner to the fixed frame and (on the other hand) of serving as a neighboring tilt support on this wing corner, which support is operated to open the wing by tilting it.

In German Pat. DT-OS No. 2,509,440, it has already been suggested in connection with the tilt-out device for turn-tilt windows, doors, a corner guide means of this type in which the shank of the angled housing for the corner guide is positioned parallel to the swing area of the tilt-out arm and has a reduced profile height, so that it extends only a relatively small distance out of the opening slot or the undercut profile groove. This flat profiled shank of the angled housing is held by edge bars arranged side-by-side in the profile groove of the wing that serves to guide the drive rod. The other shank of the angled housing that is positioned at a right angle to the swing plane of the tilt-out arm has the normal, higher profile height. However, it has been designed small enough that it engages the opening slot of the undercut profile groove with a side play. The shank may be fixedly positioned by S-shaped safety sleeves within the undercut profile groove, so that these safety sleeves interlock with longitudinal bars of this shank and are positioned outside of the profile groove. The shank of the angled housing, which has a flatly-profiled cross-section, is equipped with a longitudinal slot on its outside through which a lock pin penetrates and which is connected with a drive rod connecting piece, such as a flexible steering member, which works together with a closure fork mounted on the tilt-out arm.

The corner steering constructed in accordance with DT-OS No. 25 09 440 together with DT-PS No. 1,269,535 and DT-PS No. 1,271,592 has the disadvantage that both shanks of the angle housing for the corner guide practically fill the cross-section area that serves to guide the drive rods, so that the drive rod connection parts have to be placed in the profile grooves of the frame shank based on space savings, at least with one part of its cross section. A disadvantage appears with this type of drive-rod connections consisting of the fact that the driving rods within the undercut profile grooves have to end in front of the head side of the shank of the angle housing; consequently, they may not be pushed up to the immediate corner area of the wing of frame.

German Pat. DT-OS No. 1,801,914 shows a window made from metal or plastic in which the profile grooves within the frame shanks are arranged in steps and have a depth larger than the thickness of the driving rods. In that way, the two driving rods located at an angle to each other are coupled together by a corner guide and its angled housing with its two shanks remain outside of the moving area of the driving rods. Both shanks of the angled housing for the corner guide are fixed in position by safety sleeves which are inserted into the profile grooves in that portion of the wing corner which is normally used for the parts which serve the drive rods. Also, in this case, it is, therefore, not possible to guide the drive rods so that they pass by on at least one shank of the angle housing for the corner guiding up to the immediate corner area of the wing. Also, in this case the drive rods have to terminate at a relatively large distance from the wing end.

The windows and doors which are equipped with this type of drive rod fittings have to have their hardware design adjusted with regards to many different requirements. These requirements may, however, already be known during window or door fabrication, but they also may arise during usage on doors and windows which are already installed. With the presently-known drive rod hardware of the described type, these many requirements cannot always be satisfied, because in the known corner guiding, definite installation conditions, which permit only a small variation regarding the hardware equipment, have to be present. It is the purpose of this invention to eliminate all the disadvantages of the known type of drive rod fittings. Therefore, it is the purpose of this invention to provide latch hardware of the previously-described design principle, where the corner guide may be inserted at any selected corner of a window, door, wing, or frame and in which the insert position can be adjusted to the various requirements.

These and other difficulties experienced with the prior art devices have been obviated in a novel manner by the present invention.

With these and other objects in view, as will be apparent to those skilled in the art, the invention resides in the combination of parts set forth in the specification and covered by the claims appended hereto.

SUMMARY OF THE INVENTION

In general, the present invention solves these problems by providing a latch or drive rod mechanism in which:

(a) at least one shank of the angled housing for the corner guide has a cross-section which completely fills the part of the the profile groove within the wing or frame shanks on the side of the drive rod guide and the other shank has a cross-section which corresponds at least to the total cross-section of the profile grooves;

(b) the shank for the corner guide inserted in the profile groove, which exclusively is positioned aside of the drive rod guidance, has a longitudinal slot on the side which faces the drive rod guide and in its area a nearly completely covered drive rod connecting piece positioned within the shank cross-section is slidable and connected to a flexible direction-changing member, such as a spring steel band;

(c) the drive rod or a connecting slide is removably coupled by a bolt, pin, etc. to the drive rod connecting piece;

(d) the angled housing of the corner guide at least in an area at the corner, is fixed in position by a clamping device designed as a safety sleeve which is positioned outside the area of movement of the driving rod;

(e) a clamping device may be pushed into the drive rod guide selectively to one or to the other shank of the angled housing and may be locked on the wing, frame shank, or angled housing.

On the basis of common usage of these characteristics, the drive rod hardware may be put together for substantially all requirements without any problem and, in some cases, may be additionally supplemented.

An additional characteristic of this invention consists of the fact that the shank of the angled housing has on its outer surface in the vicinity of the corner an undercut groove or an undercut stem running lengthwise into which a clamping device, with a profiled stem or a groove, is displacable but form-locked. It is particularly desirable that the clamping device have a snap spring which may be locked within a groove on the angled housing. It is also important, in order to provide secure fastening of the corner guide, that the angled housing and the clamping device be equipped with dove-tailed slides.

Another design characteristic of this invention lies in the fact that the other shank of the angled housing is equipped with an approximate cross-shaped portion in a limiting part of its length extending along its free end with side flanges which form edge stems that engage the drive rod guide and that the area extending longitudinally near the corner of the angled housing is equidistant from the undercut areas of the driving rod guides, whereby a clamping device surrounding the shank may be pushed into the slot. This clamping device will receive a hat-shaped cross-section and a transfer stop is attached on its end for engagement in a groove at the corner of the angled housing. This clamping device may be stopped by a pressure bolt at least on the profile of the frame, but preferably on the angled housing of the corner guide.

With regard to the construction, as a practical matter, the two side walls each have an approximately F-shaped cross-section on one of the shanks of the angled housing and are opposed to one another at their free flange ends. In the opening between the two flanges, the longitudinal edges of the flexible members are guided and at least the underside of the lower flange as well as the upper side of the upper flange are each gripped by edge bars of the drive rod connecting device.

On the basis of the previously described measurements, the suggested corner guides may be used for practically all requirements, that is to say, for windows and doors with all different combinations of hardware.

BRIEF DESCRIPTION OF THE DRAWINGS

The character of the invention, however, may be best understood by reference to one of its structural forms, as illustrated by the accompanying drawings, in which:

FIGS. 1 to 6 of the drawings show only schematically a front view of the wing 1 of a window or door which is made of metal or plastic extrusion. Into each of these wings is installed a drive-rod fitting 2. The drive rod fittings 2 of the different wings 1 differ in their design arrangement and are directed to the different needs.

FIG. 1 shows a drive rod fitting 2 used with the so-called Baskuel-rod lock in which the operating drive 4 is moved by a handle 3 which moves two drive rods such as drive rod parts 5' and 5'' relative to each other. To the drive rod part 5' is coupled a control lever 6' and to the drive rod part 5'' a corresponding control lever 6''. The free end of each of the control levers 6' and 6'' act along with its closure plate 7' and 7'', respectively, which plate is inserted above and below, respectively, in the fixed frame of the corresponding wing corners at the closure side. In these wing corners additional corner guide devices 8' and 8'' may be built, which devices are (on the one hand) coupled to control levers 6' and 6'' and (on the other hand) are connected to extension rods 9' and 9'' which are guided in the horizontal wing rail 1' and 1''. To these rods are coupled additional latch elements such as control levers 10' and 10'' which are operatively connected to the wing corners at the linkage side to closure plates 11' and 11'' on the fixed frame.

Naturally, it is also possible to use only the extension rod 9' and its control lever 10' on the upper horizontal wing rail 1' by insertion of the corner guide device 8' or only use the rod 9'' on the lower wing rail corner guide device 8'' for engagement with the lock lever 10''. It is only important that the corner guide 8' and 8'' have a complete agreeable design and that the lock levers 6', 6", 10', and 10" be designed to conform.

Figure 2:
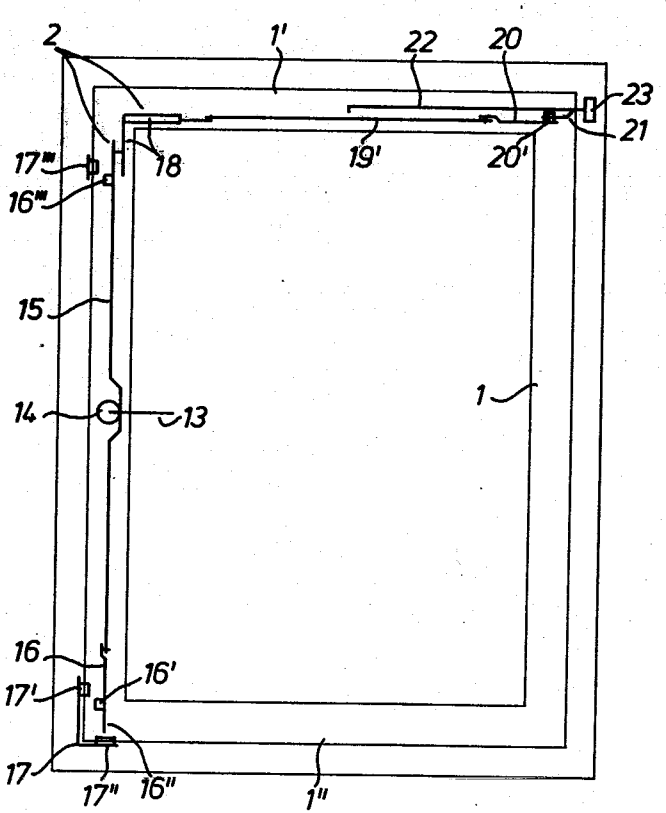
FIGS. 1 to 6 are schematic and simplified front views of a window equipped with the inventive corner guides used with the different drive rod fittings.
Figure 1:
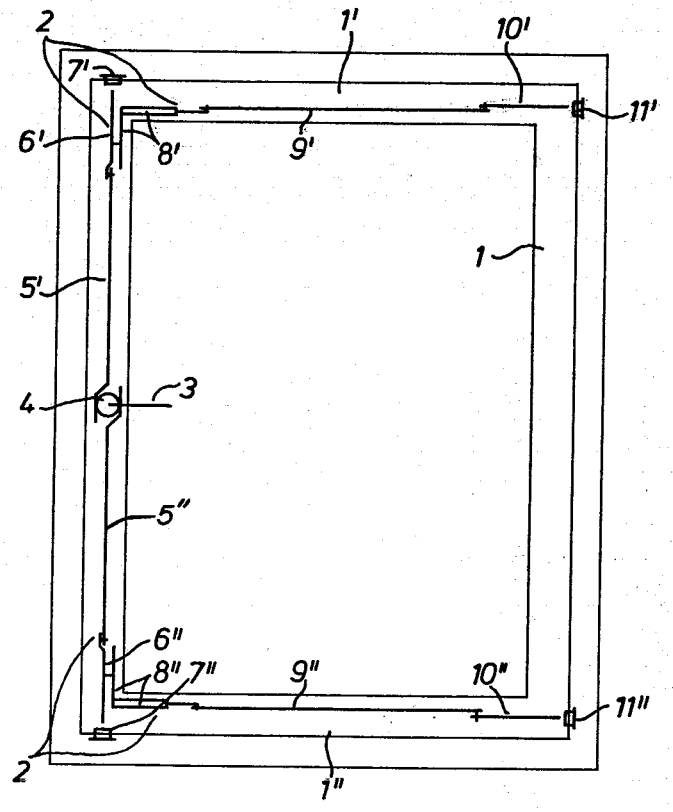

FIG. 2 shows the drive rod fitting 2 within the wing 1 used as a turn-tilt fitting of simple design. By means of a handle 13 and an operating drive 14 a drive rod 15 is displaced on the closure side rail of the wing 1. A lock lever 16 is coupled with the lower end of this drive rod and carries a lock pin 16' which takes part in the closure operation with the closure lock 17' that is mounted in the fixed frame. On the other hand, the free end 16" of this lock pin 16 is designed in such a way that it is able to operate, during tilt position, with a tilt closure plate 17" mounted to the fixed frame. It is advantageous if the closure lock 17' and the tilt closure plate 17" are arranged on a common angled piece 17. Also mounted on the upper end of the drive rod 15 is a closure lug 16"' which engages in closure switch position with a closure hook 17"'.

To the upper end of the drive rod 15 is coupled a corner guide 18 to which is connected a displacable connecting rod 19', lying in the upper horizontal wing rail 1'. The connecting rod 19' is connected to a control lever 20 provided with a control lug 20' which is operated along with a fork-shaped closure pin 21. The closure pin 21 is mounted on an adjusting arm 22 of the push-out device, the arm 22 being arranged horizontally between the groove areas of the rail 1 and the fixed frame. The push-out device on a linkage sleeve 23 is mounted on the fixed frame and lines up with the wing turning axis. In that way, the fork-shaped closure pin 21 is arranged and designed so that the closure lug 20' of the closure lever 20 engages it in the closure switch position and in the turn opening switch position of the drive rod fitting 2. The drive rod fitting 2 is disengaged in the tilt open-switch position from the closure engagement of the push-out arm 22.

Figure 3:
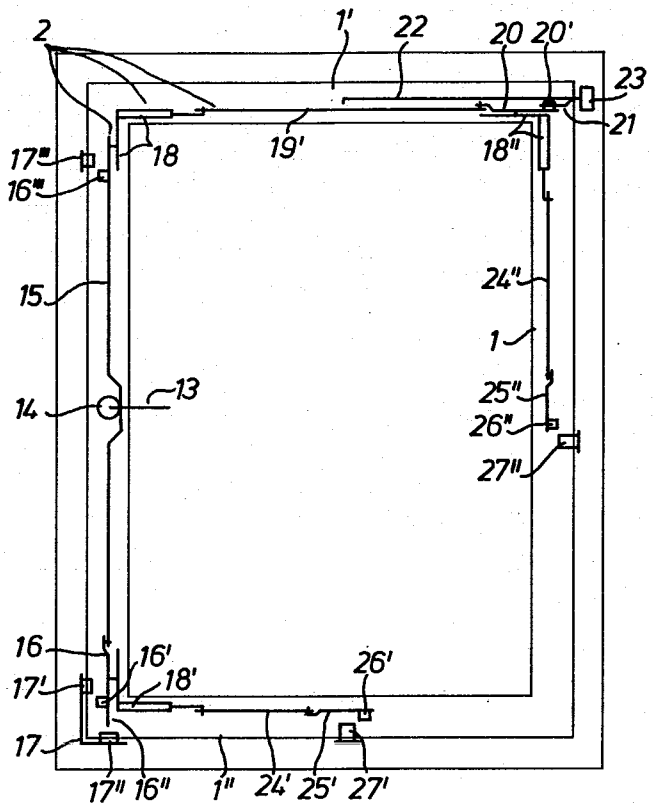

The window wing 1 in FIG. 3 has basically the same hardware equipment as the one built in accordance with the FIG. 2. It is additionally only equipped on the closure side of the lower wing corner with a corner guide 18' and on the linkage side of the upper wing corner with a corresponding corner guide 18". Connected to the corner guide 18' is a connecting drive rod 24' lying in the lower horizontal wing rail 1" and a lock lever 25' is coupled to the rail. This lock lever carries a lock lug 26' which engages a lock plate 27' mounted to the fixed frame, when the drive rod fitting is in the closure switch position. Connected to the corner guide 18" is connected, at the linkage side of the vertical wing rail, a connecting drive rod 24" engaging lock lever 25". The later carries the lock lug 26" which engages, in the closure switch position of the drive rod fitting, a lock plate 27" fixedly mounted on the frame.

Figure 4:
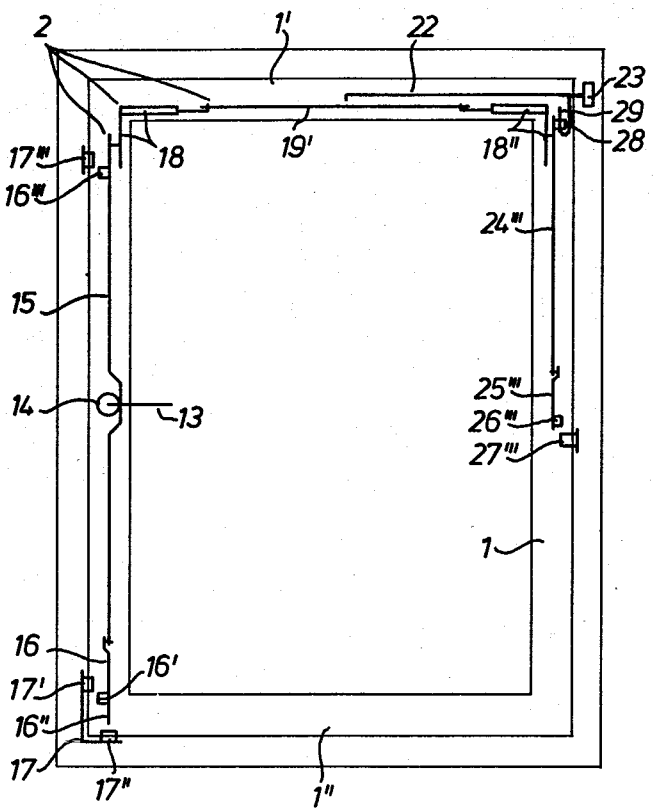

The hardware design of the wing 1 shown in FIG. 4 is identical on its closure side with the one shown in FIG. 2. At the turn linkage side of the wing 1, however, deviations are present. There is, according to FIG. 4, a connecting drive rod 19' directly connected to the corner steering 18" to which is attached the drive rod 24" at the turn linkage side. The drive rod 24"' is connected at its lower end to a closure lever 25"', which is equipped with a closure lug 26"' which acts in closure switch position in cooperation with a closure plate 27"'. On the upper end of the connecting drive rod 24"' resides a lock lug 28 which, in the closure and the turn-opening switch position of the drive rod fitting 2, interacts with a fork-shaped closure catch 29 which is positioned on the push-out device and is directed parallel to the linkage sleeve 23 on a portion of the push-out arm 22.

Figure 5:
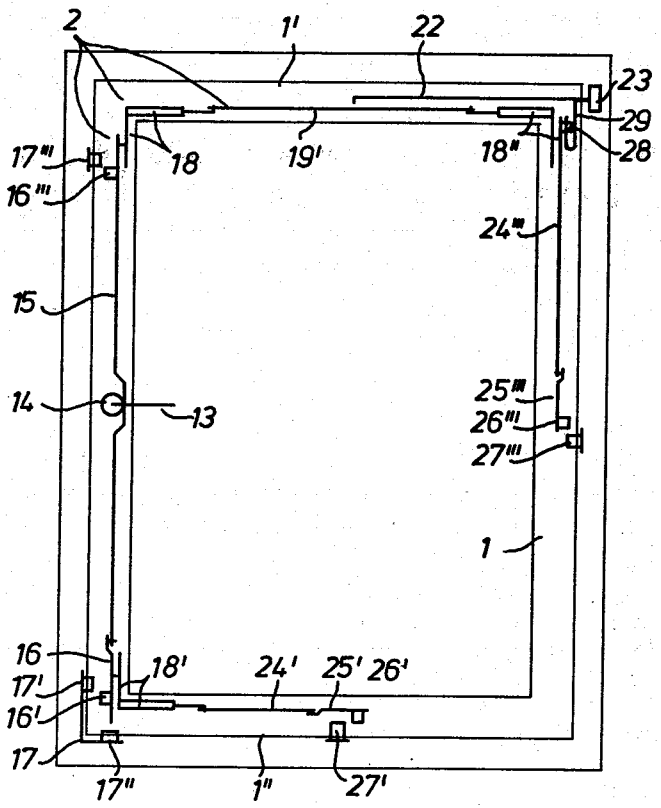

The hardware equipment of the wing 1 shown in FIG. 5 differs from the one shown in FIG. 4 only in the fact that, on the lower linkage side wing corner, the corner guide 18' is coupled to the lock lever 16 and the corner guide 18' in the lower horizontal wing rail 1" is connected to a control lever 25' by a connecting drive rod 24'. A closure lug 26' engages, during the closure switch position of the drive rod fitting, with a closure plate 27' on the frame.

Figure 6:
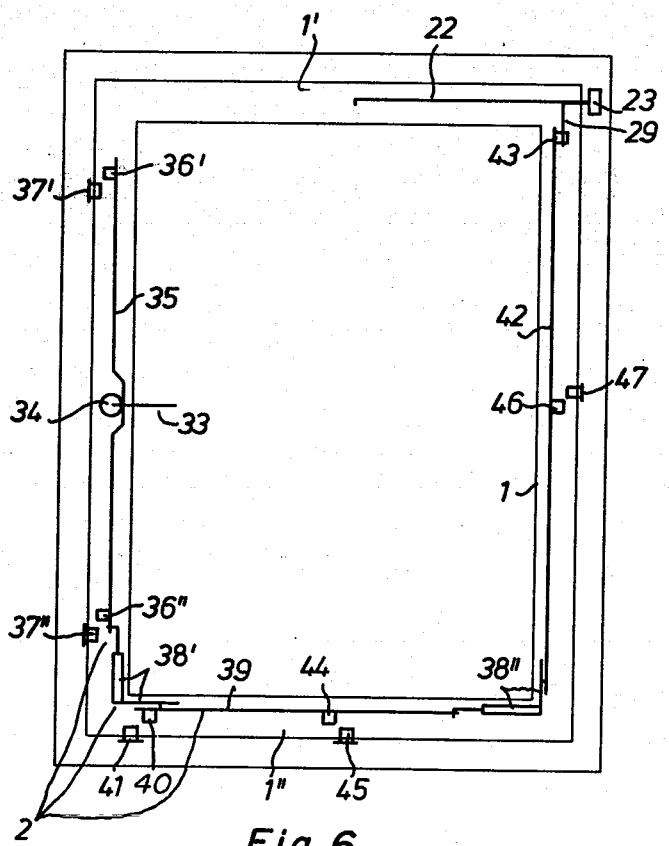

FIG. 6 of the drawing shows a window wing 1 which has hardware for a turn-tilt wing. In this case again a handle 33 and an operating drive 34 are operated to displace a driving rod 35 located in the vertical wing rail at the closure side. This driving rod is equipped with two lock lugs 36' and 36" which cooperated with lock plates 37' and 37" which are fastened to the frame, in the closure-switch position of the drive rod fitting 2. On the other hand, the drive rod is connected to the corner guide 38' on the lower wing corner at the closure side and to this is attached a drive rod 39 lying in the lower horizontal wing rail 1". This drive rod 39 carries a closure lug 40 near its front end, which engages a tilt closure plate 41 of the fixed frame only in tilt opening switch position. In addition, the drive rod is coupled with a corner guide 38" which is built into the lower turn linkage side corner guide element such as a corner of the wing 1.

Within the vertical wing rail on the turn linkage side, a driving rod 42 is mounted so that its lower end is connected to the corner guide 38", the rod being equipped with a lock lug 43. This lock lug operates, in the closure and turn opening switch position of the driving rod fitting 2, on a fork-shaped closure handle 29 which is positioned on the push-out arm 22 of the push-out device on rail directed parallel to the turn linkage sleeve 23.

On the driving rod 39 may be mounted another lock lug 44 which engages a lock plate 45 fastened to the frame in the closure switch position of the driving rod fitting 2. Also, the driving rod 42 may be equipped with a similar lock lug 46 which, in the closure switch position of the driving rod fitting 2, engages from beneath a closure plate 47 mounted on the frame.

It should be noted that hardware designs for windows and door wings 1 as shown in FIGS. 1 to 6 and described above are only a few of the designs; as a practical matter, many variations are possible. In connection with the design example, shown and described it should be made clear that a number of different design variations are possible by using the present design of corner guide.

In the description which follows, a corner guide (see particularly FIGS. 7-9) shall be described in detail and shall be designated uniformly by the reference number 48.

The corner guide 48 has an angled housing 49 which is assembled from two mirror image halves 50' and 50". Within this angled housing 49 is as shown clearly in FIGS. 10 and 14, a flexible re-directing member such as a flexible direction member 51. This member consists of several laminated spring-steel bands which are guided for stiffness in tension and compression, so that it moves within the two legs 52 and 53 of the angled housing 49 within straight line guides 54 and 55 which are connected to each other (see FIGS. 10 and 14) in the vicinity of the corner of the angled housing 49 is fixedly connected to a connecting element such as a drive rod connection piece 56 along its entire length and with its entire cross-section. The other end of the direction member 51, which extends into the other leg 53 of the angled housing 49, however, is coupled to a connecting element such as a drive rod connecting piece 57 which extends from the free end of the shank.

Figure 10:
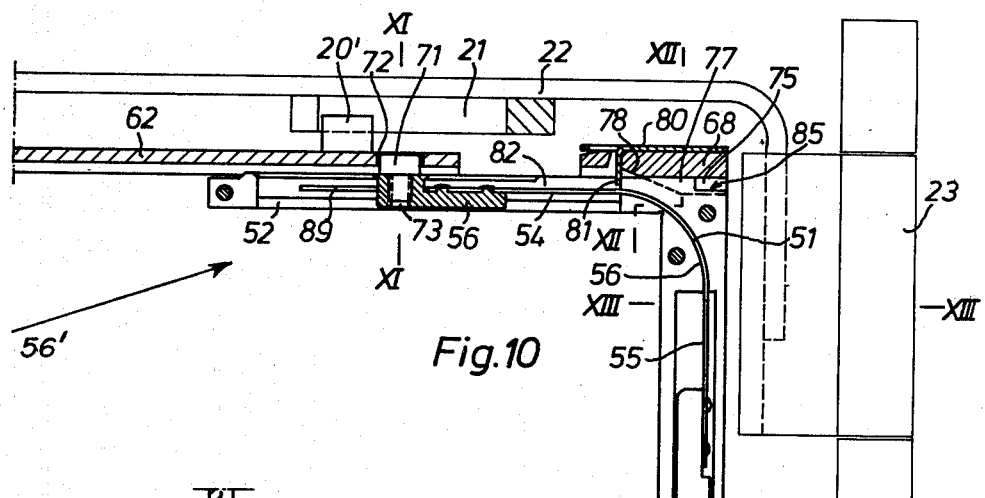
FIG. 10 is a longitudinal cross-sectional view of a corner guide device built in accordance with this invention built into a turn-tilt window in the area of the operating device.
Figure 11:
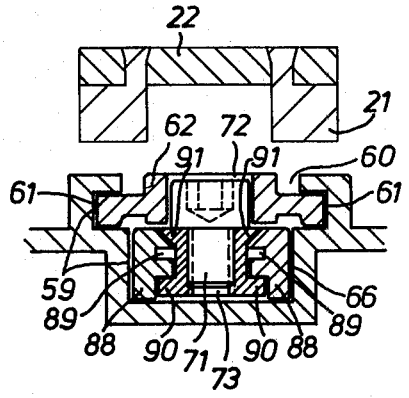
FIG. 11 is a transverse sectional view of the corner guide device taken on the line XI—XI of FIG. 10.

As can be seen in FIGS. 11, 12, 13, and 15, the corner guides 48 are set into undercut profile grooves 59 of the rails 58 of the window and these profile grooves are step-shaped in design and also serve to guide the drive rods coupled to the drive rod connecting parts 57 and 56. From these figures of the drawings, it can also be seen that the undercut profile grooves 59 have a cross-shaped cross-section and a longitudinal slot 60. Within the cross-section area of the profile groove 59, having the undercuts 61 directly beside the longitudinal slot 60, the driving rods 62 and 63 (FIG. 10) and the driving rods 64 and 65 (FIG. 14) are slidably guided in the longitudinal direction. The total depth of the profile grooves 59 is, however, dimensioned in such a way that the smaller cross-section 66 of the groove (facing away from longitudinal slot 60 and opposite the undercuts 61) is not in the path of the driving rods 62 to 65, as can be seen in FIG. 11 with respect to the driving rod 62.

Figure 7:
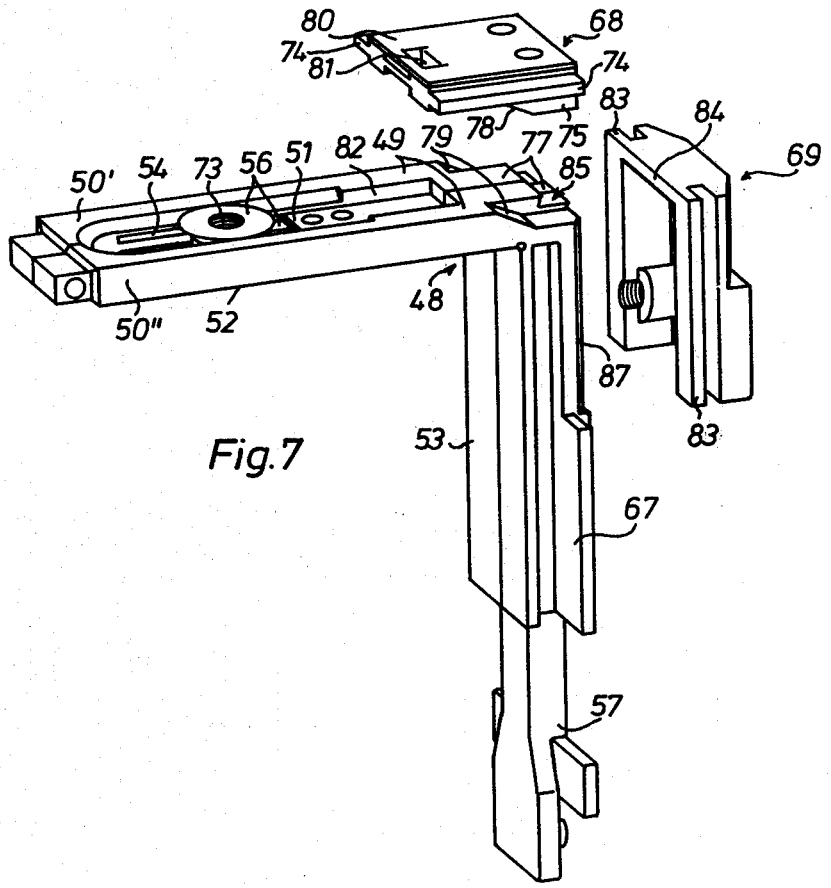
FIGS. 7 to 9 are different perspective views of a corner guide and its parts constructed in accordance with the invention.
Figure 8:
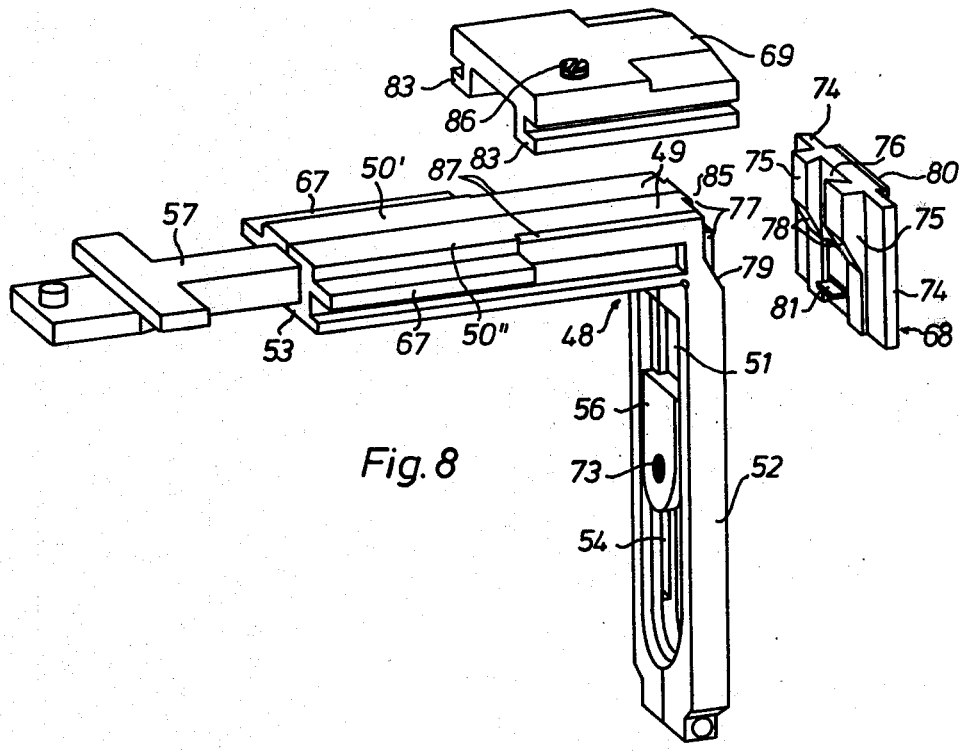
Figure 9:
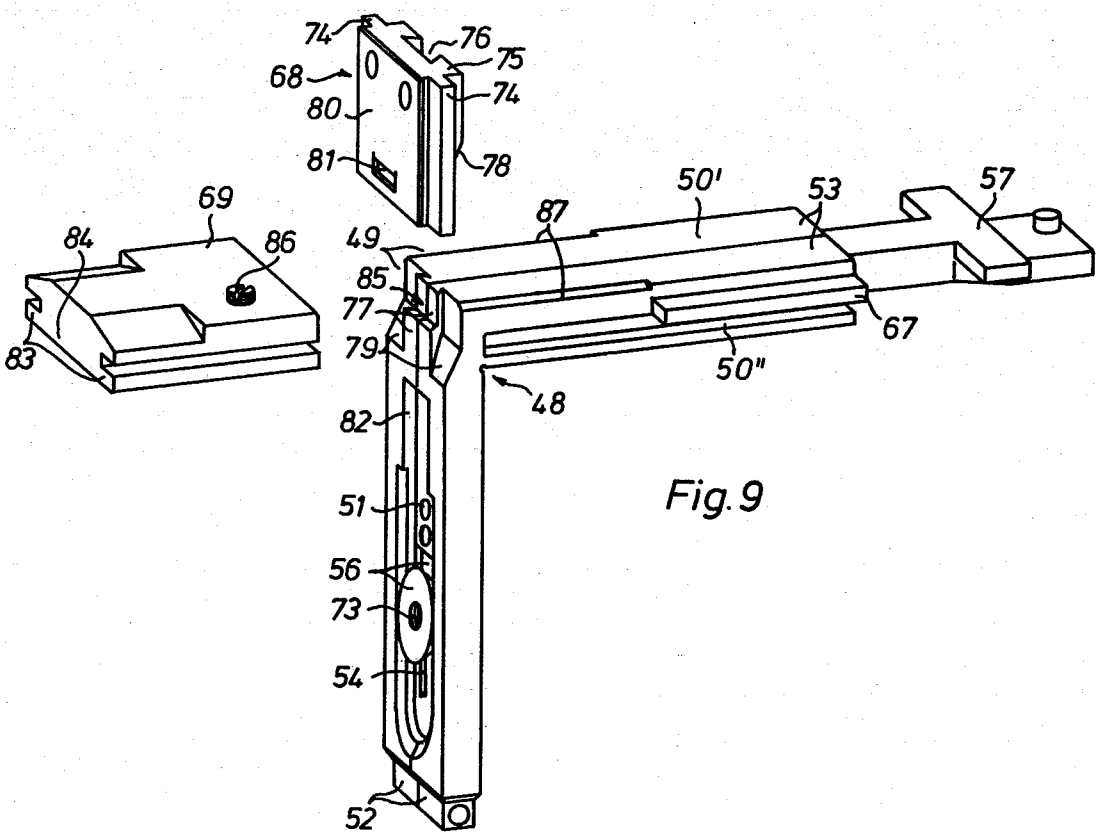
Figure 12:
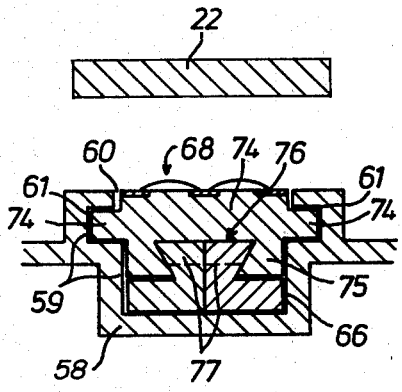
FIG. 12 is a sectional view taken on the line XII—XII of FIG. 10.
Figure 13:
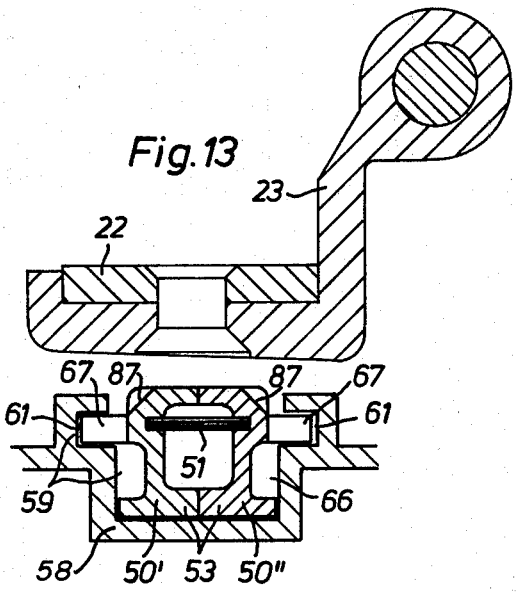
FIG. 13 is a sectional view taken on the line XIII—XIII of FIG. 10.
Figure 15:
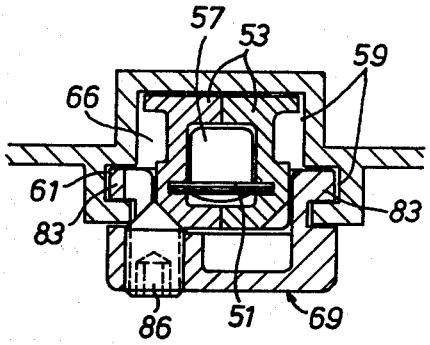
FIG. 15 is a sectional view taken on the line XV—XV of FIG. 14.
Figure 16:
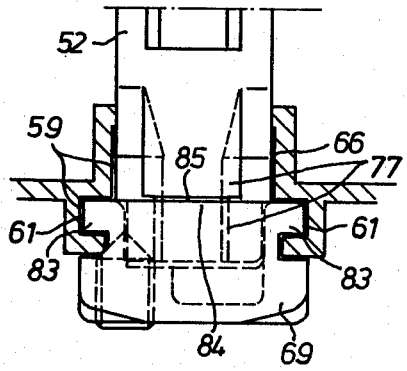
FIG. 16 is an end elevational view taken in the direction of the arrow XVI in FIG. 14.

As can be seen from FIGS. 11 and 12, the shank 52 of the angled housing 49 has cross-section dimensions which are suitable in width and height to the part 66 of the profile groove 59, so that the whole leg 52 is housed in the profile groove 59. FIGS. 13 and 15 show that the leg 53 of the angled housing 49 may have a cross-section height which is approximately equal to the height of the profile groove 59. In FIGS. 7 to 9 it can be seen that the edge webs 67 are formed on the leg 53 of the angled housing 49, starting at its free end and extending along both sides to a maximum at half the length of the leg 53. With the help of the edge webs 67, the angled housing 49 is locked into the undercut part 61 of the profile groove 59, while the other leg 52 of the angled housing 49 takes a position within the right angle running profile groove 59, as can be recognized in FIGS. 11 and 12.

Figure 14:
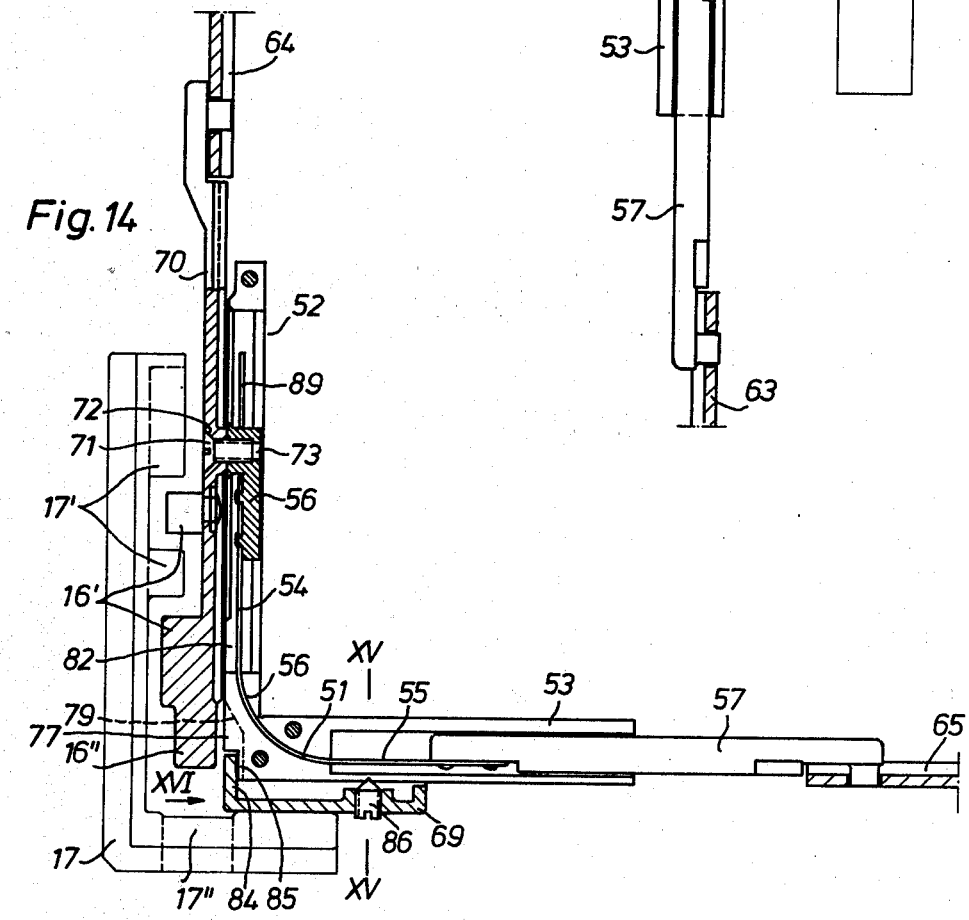
FIG. 14 is a longitudinal sectional view similar to FIG. 10 through the corner guide device, but taken in the operating area of the tilt-lock closure fitting of a turn-tilt window.

The final fixed position of the corner guide 48, i.e., within the undercut profile grooves 59 of the wing or frame corner and running at a right angle to each other, is brought about by clamping means such as special safety sleeves 68 or 69 which are designed in accordance with the different mounting conditions and various mounting conditions for the corner guide 48. Consequently, the safety sleeve 68, for the final positioning of the corner guide 48, is pushed into the undercut areas 61 of the profile groove 49 parallel to the shank 52 (see FIGS. 10 and 12). In comparison, the safety sleeve 69 is inserted into the undercut areas 61 of the profile groove 59 in the direction parallel to the longitudinal direction of the leg 53 (see FIGS. 14 and 15). The two safety sleeves 68 and 69, however, are not used at the same time, but only one or the other is used. The design and operation of the safety sleeves will be described later on. First, it must be pointed out that, during installation of the corner steering 48, it is possible that a lock lever 70 (FIG. 14) coupled to a driving rod 64 or a driving rod 62 (FIGS. 10 and 11) within the undercut profile groove, may be able to pass by on the shank 52. In the event that a safety sleeve 68 is used for fixing the corner steering 48 in place, the driving rod 62 may be pushed approximately into the corner area of the wing or frame, as can be seen in FIG. 10. However, in event that the safety sleeve 69 is used for final fixing in place of the corner guide, then even the driving rod 64 and the lock lever 70 that is coupled with the driving rod may be pushed along the leg 52 of the corner guide 48 up to and beyond the corner area of the wing or frame, as can be seen in FIG. 14.

The coupling of the drive rod 62 or 64 or the one for the lock lever 70 with the driving rod connecting part 56 of the corner steering is made with a pressure bolt or screw 71 which is installed through a hole 72 in the drive rod 62 or 64 or the lock lever 70 into a corresponding hole 73 of the closure lever 56 transversely of the slide direction. Therefore, the possibility exists of coupling the driving rod or the lock lever with the driving rod connecting part even after the installation of the corner guide 48.

The design of the driving rod connecting piece 57, however, is such that the drive rod 63 or 65 has to be already coupled during installation of the corner guide.

As can be seen in FIG. 12, the safety sleeve 68 has a profile part 74 which corresponds in general to the cross-sectional shape of the drive rods 62 to 65, so that it is form-locked and pushed into the undercut areas 61 of the profile groove 59. On the underside, however, is molded an additional profile section 75 which is designed as an undercut groove 76.

To match the groove 76, a corresponding tongue 77 is arranged on the housing 49 of the corner guide 48, which tongue extends into the area of the corner zone of the angled housing 49 parallel to the longitudinal direction of the leg 52. During the insertion of the safety sleeve 68 into the undercut area 61, the profile groove 59 of the safety sleeve couples tightly with the angled housing 49 of the corner guide 48.

So that a durable connection between the safety sleeve 68 and the housing 49 for the corner guiding is guaranteed, the safety sleeve 68 is equipped with a sloped surface 78 and the angled housing 49 is provided with a correspondingly sloped surface 79 to make the tight connection.

Additionally, the safety sleeve 68 carries a snap spring 80 which engages with a sloped tongue 81 in front of the rear end of a longitudinal slot 82, which creates the coupling connection between the driving rod connection piece 56 and the driving rod 62 or the coupling lever 70 by means of the bolts or screw 71.

The snap spring is designed and arranged in such a way that, during the insertion of the safety sleeve 68 over the wedge 79 on the angled housing 49, the spring is forcably lifted and, thereafter, its sloped part 81 automatically engages the rear end of the longitudinal slot 82.

The safety sleeve 69 has a generally hat-shaped cross-sectional shape, so that it surrounds (on one hand) the cross-section of the leg 53 of the angled housing 49 and (on the other hand) is form-locked with the undercut area 61 of the profile groove 59 with the two longitudinal bars 83. The safety sleeve 69 has at its rear end a cross wall 84 which engages a step 85 at the corner of the angled housing 49 (see FIG. 14), so that its outside surface at least is flush with the outside of the leg 52 of the corner guide 48. The stationary mounting of the safety sleeve 69 to prevent unintentional displacement is brought about by use of a clamp screw 86. This screw is supported on at least one of the profile bars of the wing or frame arm; additionally and preferably, it is supported on the area 87 of leg 58 of the angled housing 49.

The type of fastening of the corner steering 48 shown in FIGS. 10 to 12 will always be used when a mounting space for further hardware between the wing and frame is necessary directly beside the leg 53 of the angled housing 49. This is the case, for example, as shown in FIG. 10, where the linkage band 23 of a push-out device 22 has been housed at the side of the shank 53 of the angled housing 49. The locking of the push-out lever is operated horizontally above the closure fork 21 and the lock pin 20' (compare also with FIG. 3 at the upper right-hand corner).

The type of fastening for the corner, as shown in FIG. 14, is always used when, on the shank 52 of the angled housing 49, a driving rod or a lock lever has to be pushed out of the wing corner. This type is used, for example, on a tilt-lock closure device for a tilt-turn wing as shown in FIG. 14 (compare also with FIGS. 3 and 5 lower left corner) or on a Baskuel-type closure shown in FIG. 1, upper left and lower left. In the case of FIG. 2, upper left, both fastening types may be used selectively. The same is also true for FIG. 4, upper left, but for FIG. 4, upper right, the fastening type of FIG. 14 is preferred, as is true also of the hardware design in FIG. 6, lower right and left.

In conclusion, it should be pointed out that each of the two side walls 88 of the leg 52 of the angled guide have an approximately F-shaped cross-section and lie with their flange ends in opposition, as shown in FIG. 11. The longitudinal edges of the flexible steering member 51 are guided within the slot 89 between the two flanges and the underside of the lower flange is engaged beneath by angle bars 90 connected with the drive and connecting piece 56 of the guiding member 51. The upperside of the upper flange is sloped towards the inside and serves to support correspondingly sloped bars 91 on the upper side of the driving rod connecting pieces 56.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Latch hardware for windows and door frames provided with frame members having grooves which are substantially cross-shaped in cross-section including lateral undercut portions and a base portion extending below the undercut portion, said latch hardware comprising:

(a) at least two drive rods displacably guiding within the undercut portions, respectively of two adjacent frame members extending at an angle to one another to form a corner, (b) latch elements connected to each drive rod, (c) an L-shaped corner guide element positioned in the corner of said frame members, one leg of the guide element being disposed within the groove of the adjacent frame member and having a cross-section which substantially fills said groove, the other leg of the corner guide having a cross-section which fills the base of the groove of the adjacent frame member and has a longitudinal slot on the side facing the adjacent frame member, (d) a pair of connecting elements connected, respectively, to said two drive rods, one of the connecting elements being slidable within said longitudinal slot and the other connecting element being guidingly mounted with respect to said one leg of the guide element, (e) a flexible re-directing member extending within the corner guide element for connecting the pair of connecting elements, and (f) clamping means located in the grooves of the frame members outside of the movement area of the drive rods for clamping the corner guide element in the corner position within the frame.

2. Latch hardware as recited in claim 1, wherein the clamping means comprises:

(a) a clamping member slidably mounted on said other leg of the corner guide in the longitudinal direction by means of a tongue and groove mounting and lateral portions which extend in the undercut portions of the frame grooves, and (b) means for locking the clamping member in place on said other leg of the corner guide.

3. Latch hardware as recited in claim 2, wherein the end of the longitudinal slot adjacent the frame terminates to form an end wall, said other leg of the corner guide having a shoulder which extends at an angle to the longitudinal axis of said other leg and clamping member having a shoulder which abuts the shoulder of said other leg, and wherein the means for locking the clamping member in place comprises a flat spring fixed to the clamping member and extending into the longitudinal slot in tight contact with said end wall to maintain said shoulders in tight engagement.

4. Latch hardware as recited in claim 3, wherein said shoulders are sloped at the same angle, thereby allowing the shoulder of the clamping member to slide on the shoulder of said other leg to provide a wedging action for tightly holding the corner guide element in the corner position.

5. Latch hardware as recited in claim 1, wherein said one leg of the guide element is substantially cross-shaped in cross-section including side flanges which extend into said undercut portions and extend along a portion of the length of said one leg, and wherein said clamping means comprises a clamping member having side flanges which extend into said undercut portions along the remaining portion of the length of said one leg and means for locking said clamping member and corner guide in the corner position within the frame.

6. Latch hardware as recited in claim 5, wherein said remaining portion of the length of said one leg and said clamping member are adjacent the corner of the frame.

7. Latch hardware as recited in claim 1, wherein said flexible re-directing member is an elongated flat leaf spring extending freely through the corner guide element, the ends of said leaf spring being connected to the respective ends of said connecting elements which are adjacent the corner of the frame.

* * * * *